US006304789B1

(12) United States Patent
Shea

(10) Patent No.: US 6,304,789 B1
(45) **Date of Patent: *Oct. 16, 2001**

(54) BOWLING CENTER SYSTEM

(76) Inventor: Michael J. Shea, 1726 Creek Crossing Rd., Vienna, VA (US) 22182

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/195,988

(22) Filed: Nov. 19, 1998

Related U.S. Application Data

(60) Provisional application No. 60/065,471, filed on Nov. 19, 1997.

(51) Int. Cl.[7] ..... G06F 155/00

(52) U.S. Cl. ..... 700/92; 434/249; 463/43; 473/54

(58) Field of Search ..... 473/54, 57, 64, 473/70, 73, 86; 463/30, 31, 35, 43; 700/91, 92; 434/249; 482/8, 902

(56) References Cited

U.S. PATENT DOCUMENTS

| | | | | |
|---|---|---|---|---|
| Re. 30,467 | | 12/1980 | House et al. | 364/411 |
| Re. 30,471 | | 1/1981 | Reynolds | 273/540 |
| 4,302,010 | | 11/1981 | Kaenel | 273/540 |
| 4,824,109 | | 4/1989 | Cervantes | 273/540 |
| 5,101,354 | | 3/1992 | Mowers et al. | 364/410 |
| 5,198,976 | * | 3/1993 | Form et al. | 364/410 |
| 5,450,318 | * | 9/1995 | Mowers et al. | 364/410 |
| 5,618,238 | | 4/1997 | Kruse et al. | 473/70 |
| 5,628,693 | | 5/1997 | Mowers et al. | 473/86 |
| 5,683,080 | | 11/1997 | Vaioli et al. | 473/69 |
| 5,719,548 | | 2/1998 | Stirling et al. | 340/323 B |
| 5,842,929 | * | 12/1998 | Moody et al. | 473/70 |
| 5,857,912 | | 1/1999 | Freitag | 463/42 |

* cited by examiner

*Primary Examiner*—Joe H. Cheng
*Assistant Examiner*—Kim T. Nguyen

(57) ABSTRACT

A bowling center system includes first and second pinsetters each associated with a respective corresponding one of first and second bowling lanes. A communication device communicates data to bowlers and a lane pair control system is configured to control the pinsetters, to receive pin data from said pinsetters during current bowling, to generate current scoring data based on the received pin data, and to supply signals corresponding to the generated current scoring data to the communication device, whereby the current scoring data is communicated to the bowlers. The lane pair control system is further configured to access stored game data corresponding to previous bowling and to supply signals corresponding to the accessed stored game data to the communication device, whereby the accessed stored game data is communicated to the bowlers.

20 Claims, 3 Drawing Sheets

BOWLING CENTER SYSTEM

RELATED APPLICATION

This application claims priority from provisional application No. 60/065,471, filed Nov. 19, 1997, the contents of which are incorporated herein in their entirety.

TECHNICAL FIELD

The present invention generally relates to bowling center systems and, more particularly, to a bowling center system which provides for the use of previously stored game data.

BACKGROUND OF THE INVENTION

As described in U.S. Pat. No. 5,101,354, bowling center systems generally include a plurality of pairs of bowling lanes, with each lane including an automatic pinsetter. The automatic pinsetter is operable to automatically control pinsetter cycles within a bowling game. Under automatic control, the pinsetter at the beginning of each frame sets ten pins on the deck. The bowler is permitted to roll a maximum of two balls to attempt to knock down all of the pins. The frame ends after all of the pins are knocked down or after two balls are rolled, whichever occurs first. The game consists of ten such frames.

These systems generally include automatic scoring systems which are coupled to both pinsetters in a lane pair for automatically processing pin fall information for the two lanes and displaying bowler's scores on scoring system monitors and on overhead displays such as CRT displays. Suitable interconnections are provided between the scoring system and pinsetter so that pin fall information can be transmitted from pin fall sensing devices associated with the pinsetter to the scoring system.

Bowling center systems also generally include a manager's control system in electrical communication with the scoring systems. The function of the manager's control system is to provide administrative control over the operation of the automatic pinsetters and the scoring systems. For example, the manager's control system is utilized to provide lane status report information, to upload the video score display from any scoring system and to provide score correction for a particular scoring system. The manager's control console also includes provision for causing messages to be displayed at a preselected scoring system, to transfer lane scoring information from one scoring system to another, and provide for tournament display by displaying a pair of lane scores on any selected number of overhead CRT's.

While bowling is a popular participation sport, it is nonetheless desirable to develop new enhancements in order to maintain and expand the sport's popularity.

SUMMARY OF THE INVENTION

In accordance with the present invention, a bowling center system includes first and second pinsetters each associated with a respective corresponding one of first and second bowling lanes. A communication device communicates data to bowlers and a lane pair control system is configured to control the pinsetters, to receive pin data from said pinsetters during current bowling, to generate current scoring data based on the received pin data, and to supply signals corresponding to the generated current scoring data to the communication device, whereby the current scoring data is communicated to the bowlers. The lane pair control system is further configured to access stored game data corresponding to previous bowling and to supply signals corresponding to the accessed stored game data to the communication device, whereby the accessed stored game data is communicated to the bowlers.

The features and advantages of the present invention will be better understood from a reading of the following detailed description in conjunction with the accompanying drawings.

DETAILED DESCRIPTION

Figure 1:
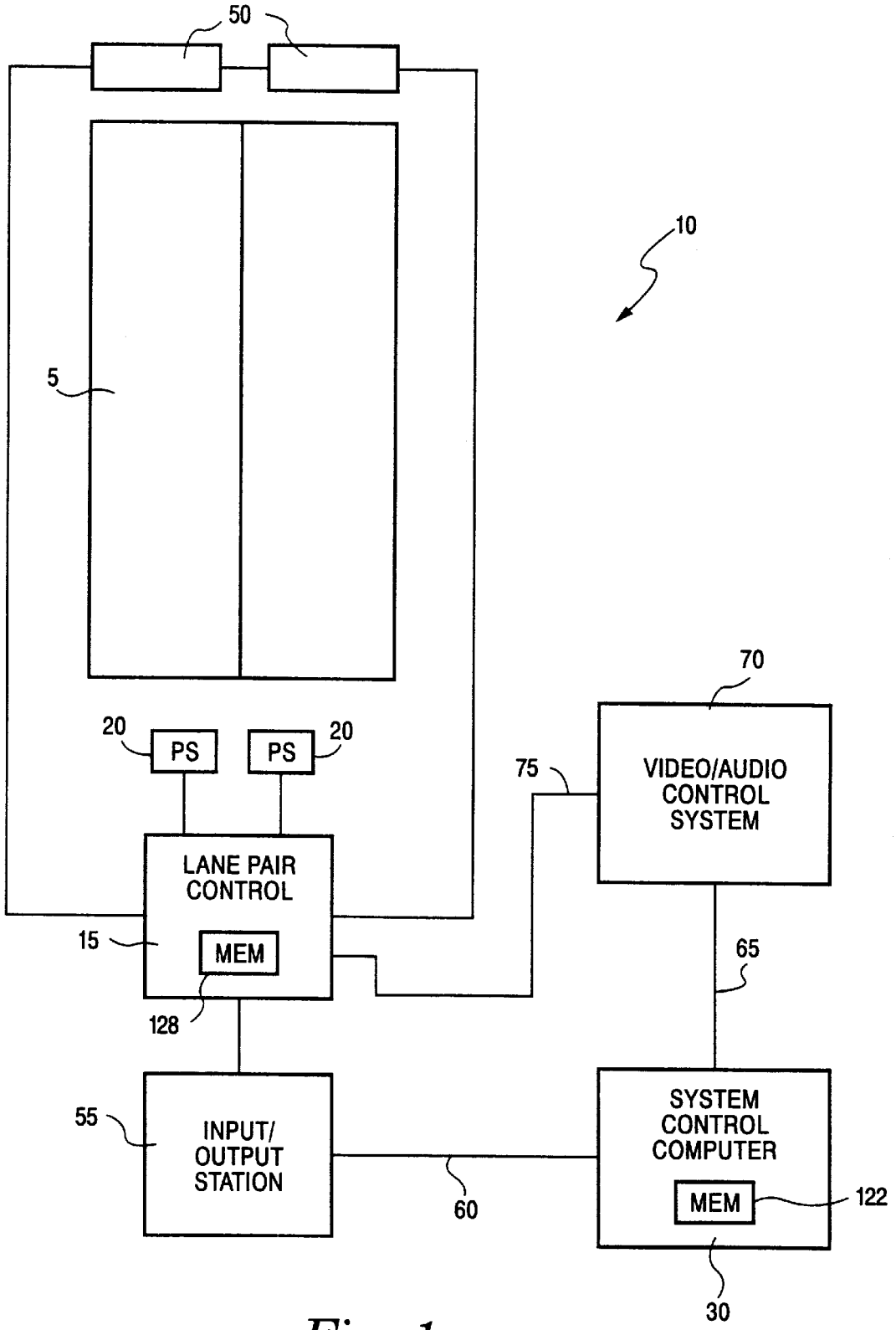
FIG. 1 is a diagram of a bowling center system in accordance with the present invention.

FIG. 1 is a block diagram of a bowling center system in accordance with the present invention and shows a bowling center ("house") 10. The bowling center is generally configured along the lines of a conventional bowling center such as the one described in U.S. Pat. No. 5,101,354, the contents of which are incorporated herein.

The bowling center includes a plurality of lanes, wherein the lanes are grouped into lane pairs. Thus, lanes 1 and 2 are a first lane pair, lanes 3 and 4 are a second lane pair, etc. A pinsetter is associated with each lane and the two pinsetters of each lane pair are connected to a corresponding lane pair control system. Each lane pair control system controls the operation of both of the pinsetters connected thereto and provides automatic scoring for bowling games played on the associated lanes. For example, for league bowling, the lane pair control system may operate the pinsetters connected thereto so that a cross lane bowling game is played on the two lanes, while for open bowling, the lane pair control system may operate the pinsetters connected thereto so that separate games may be played on each lane.

For purposes of clarity, FIG. 1 shows the elements associated with a single lane pair of bowling center 10. A lane pair control system 15 is associated with a lane pair 5 at bowling center 10. Each lane of lane pair 5 includes an automatic pinsetter 20. Pinsettters 20 are connected to lane pair control system 15. Each lane pair control system 15 is connected to corresponding display units 50 for displaying information such as bowler line-up and bowler scoring data to bowlers. Although FIG. 1 shows two display units 50 connected to each lane pair control system, the invention is not limited in this respect. Lane pair control system 15 automatically processes pin fall data provided by pin fall detectors of pinsetters 20. The lane pair control system controls the associated displays to display scores based on the pin fall data. More specifically, the pin fall detectors (such as an optical detector) detects the number of pins knocked down when a bowler rolls a ball down the alley and the bowlers score is generally based on the number pins knocked down. The pin fall data generated by the pin fall detector is supplied to lane pair control system and the lane pair control system automatically computes the bowlers' scores and causes the scores to be displayed in a suitable format on the one or more displays.

Each lane pair control system 15 is also connected to a corresponding bowler data input/output station 55. Bowler data input stations 55 permit bowlers to input data such as bowler names and line-ups for bowling games. Each bowler input station may include an input device, such as a keypad, for permitting bowlers to enter, for example, appropriate bowler identification information (e.g., bowler names), handicap information, game type information (open bowling, league bowling, inter-house bowling, etc.), and the like.

All of the lane pair control systems of bowling center 10 (including lane pair control system 15) are connected to a system control computer 30 over communication line 60. System control computer 30 provides administrative control for the lane pair control systems of the bowling center including accounting control and the downloading of game information to the lane pair control systems. System control computer 30 communicates over local communication line 65 to video/audio control system 70. Video/audio control system 70 is connected over video/audio distribution line 75 to each of the lane pair control systems. The video/audio control systems are responsive to commands from the system control computers to transmit video/audio information to the lane pair control systems for subsequent display on display units 50 and output via speakers (not shown).

Bowling center 10 provides for the storage of game data of one or more bowling games. This game data may include, but is not limited to, some or all of the following: bowler identifying data for identifying bowlers (e.g., names and/or identification numbers); bowler line-up data indicating the line-up (order) of bowlers for the game; bowler handicap data for each bowler; game time and date information; lane identifying information for identifying the lanes on which the game was bowled; and scoring information (e.g., for each ball rolled by the bowlers during the game, which pins were knocked down, the total number of pins knocked down, etc.). This game data is stored in a memory 128 associated with the lane pair control system and may later be supplied to a memory 122 associated with the system control computer 30 or output to a portable memory module (e.g., magnetic floppy disk, optical disk, smart card, etc.) via a memory module reader/writer associated with the bowler data input/output station 55.

The stored game data is used to "replay" the game(s) at some other time. For example, a first team of bowlers may bowl some number of games in a cross-lane manner on lanes 1 and 2. In a typical league, the team may comprise three to five bowlers and the team bowls three games. Game data associated with the games bowled by the first team is stored in a memory 128 of the lane pair control system 15 associated with lanes 1 and 2. As described above, the game data for each game may include bowler identifying data for each of the bowlers on the first team; bowler line-up data; bowler handicap data for each of the bowlers on the first team; time (e.g. start time) and date information for the game; lane identifying information identifying lanes 1 and 2 as the lanes on which the game was bowled; and scoring data for each bowler for the game. The scoring data may take a variety of forms. For example, the scoring data may comprise a record of the number of pins knocked down by each ball rolled by each bowler. If desired, the record may also include an identification of which particular pins were knocked down by each ball rolled by each bowler. Alternatively, the scoring data may simply comprise a record of each bowler's frame-by-frame scoring total. In still another alternative form, the scoring data may comprise a frame-by-frame scoring total for some frames (e.g., frames 1–8) and a ball-by-ball scoring total for some other frames (e.g., frames 9 and 10). The bowler identifying data, bowler line-up data, bowler handicap data, and lane identifying data are generated for each game based on inputs via bowler data input/output station 55 and time and date information generated by the lane pair control system 15 or system control computer 30. The scoring data is generated by the pinsetters 20 and lane pair control system 15 as the bowlers bowl as described above. The game data may be supplied to the memory 122 of system control computer 30 or to the portable memory module after the first team completes the bowling of all games or may be supplied periodically (e.g., after a certain number of frames, after each game, etc.). Of course, there is no requirement that the game data be supplied anywhere, provided that sufficient memory is incorporated into lane pair control system 15. Specifically, while certain advantages are obtained by supplying the game data to a memory 122 of system control computer 30 or to a portable memory module (e.g., minimizing the amount of memory which must be provided for each lane pair control system 15, enhancing the ease with which the game data is provided to any desired one of the lane pair control systems, etc.), the advantages of the present invention may be obtained when the game data is stored in memory 128 of lane pair control system 15. In addition, certain of the above-identified disadvantages may be addressed by configuring only a certain one or more of the lane pair control systems 15 in accordance with the teachings of the present invention. Thus, only these certain lane pair control systems need have the memory required for storage of the game data.

Figure 2:
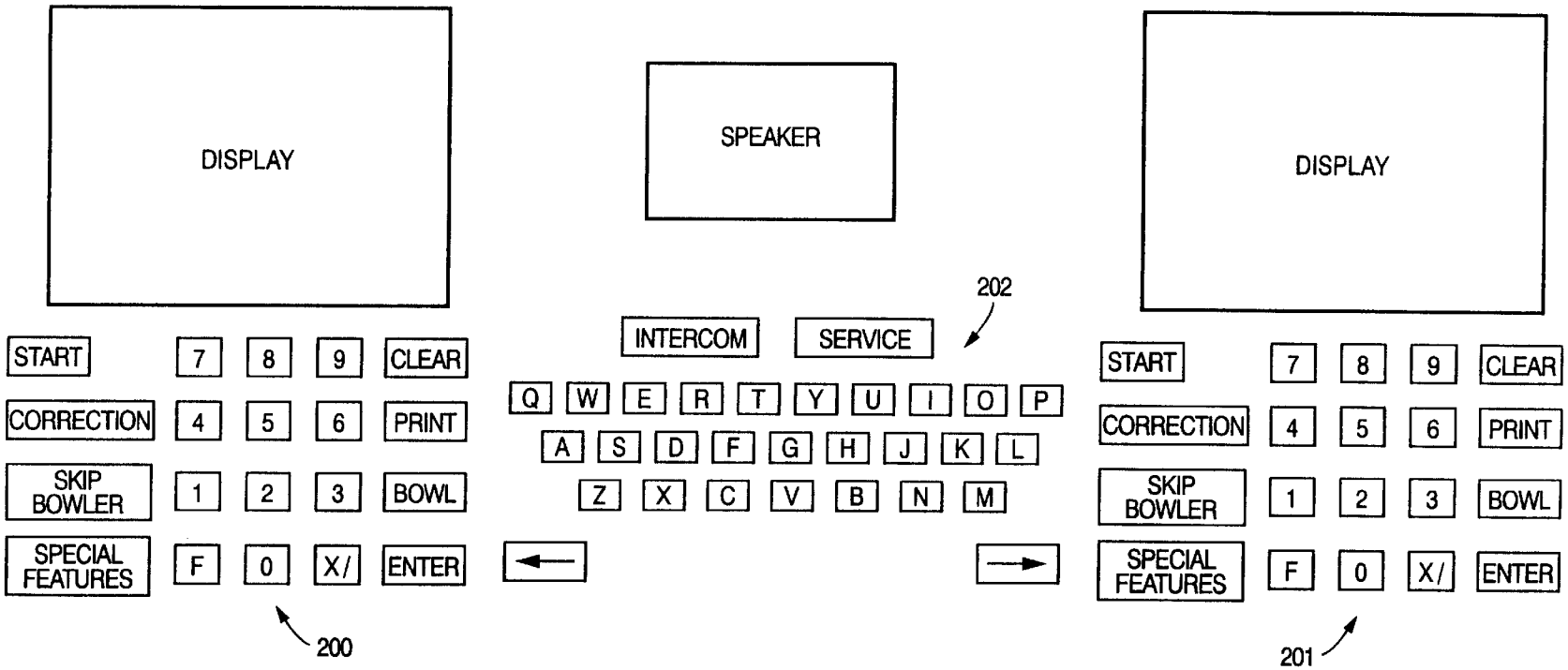
FIG. 2 shows an interface usable in connection with the present invention.
Figure 3B:
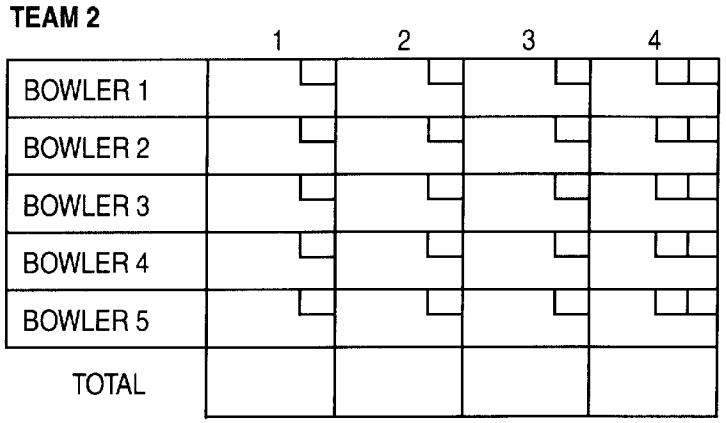
FIGS. 3A, 3B, 4A and 4B show displays of scoring data in accordance with the present invention.
Figure 3A:
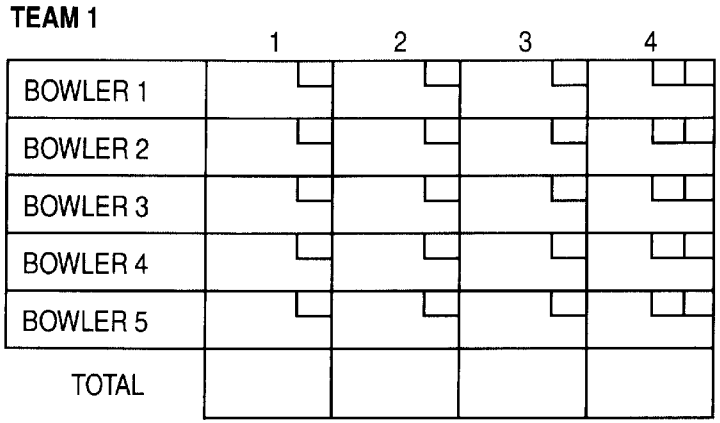
Figure 4B:
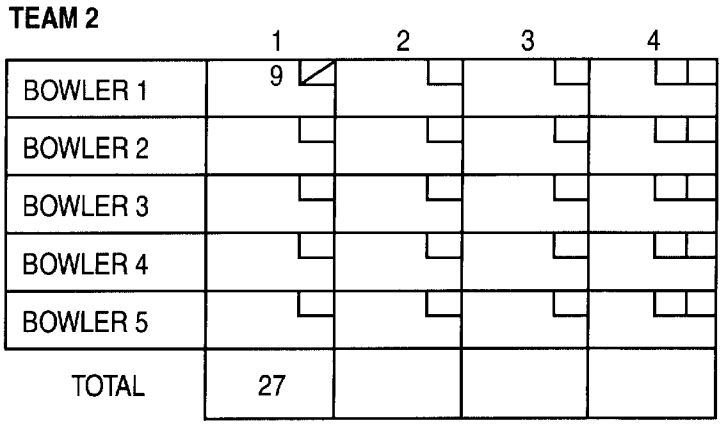
Figure 4A:
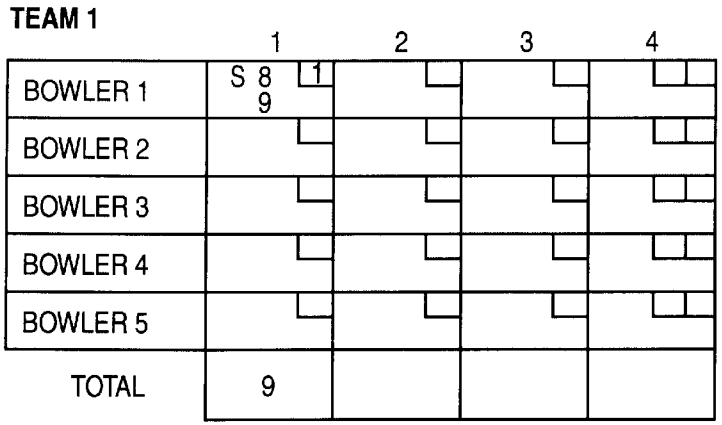

The stored game data is used at some other time. For example, the stored game data may be used in a competition between the first team and a second team bowling at a different time and/or date than the first team. That is, while the second team is bowling, the stored game data may be used to communicate to the bowlers on the second team the performance of the bowlers on the first team. For example, the user interface of the bowler data input/output station 55 may be configured to accept user input (e.g., a menu selection) for accessing the stored game data during the otherwise conventional process for entering bowler identifying data, line-up data, handicap data, etc. In particular, the user interface of bowler data input/output station 55 generally has a configuration similar to that shown in FIG. 2. For cross-lane competition between two teams of bowlers, each team will generally use one or the other of the keypads and associated displays 200 and 201, and keypad 202. In the system of the present invention, the second team enters the data in a conventional manner using the interface of FIG. 2. The game data of the first team may be accessed, for example, by pressing the "Special Features" button. Pressing this button causes a menu or menus to be presented from which the appropriate game data of the first team may be selected. Alternatively, a user of the system control computer may configure the lane pair via commands sent from the system control computer to the lane pair control system such that the game data of the first team is utilized. In response to the selection via the interface of FIG. 2 or to the commands sent from the system control computer, the control unit of lane pair control system 15 accesses either memory 122 of the system control computer 30, the memory 128 of the lane pair control system, or a portable memory module received by a reading/writing device associated with bowler data input/output station 55 to retrieve the stored game data. The "Bowl" button then may be pressed to begin bowling. When the "Bowl" button is pressed, one or more of displays 50 and the displays of the bowler data input/output station 55 are controlled to display scoring data. An initial display for one or more of displays 55 is shown in FIGS. 3A and 3B. Of course, while the displays of FIGS. 3A and 3B show four frames, the displays may be controlled to show more or fewer frames, if desired. After bowler 1 of the second team completes bowling in the first frame, the display of FIG. 3B is updated to display his/her scoring for this frame as shown in FIG. 4B. Specifically, bowler 1 of the second team knocked down nine pins with the first ball and knocked down the remaining pin with the second ball to achieve a spare in the first frame. In addition, at this time, the display of FIG. 3A is updated to reflect the score of the first bowler of the first team in frame 1 of the first game. Specifically, bowler 1 of the first team knocked down eight pins with the first ball (leaving a split) and knocked down one pin with the second ball for a total score of 9 for the first frame. Similarly, when bowler 2 of the second team completes bowling in the first frame, the display shown in FIG. 4B is updated to display his/her scoring for this frame and the display shown in FIG. 4A is updated to display the scoring of the second bowler of the first team in frame 1 of the first game. This process continues throughout each game that is bowled. A running indication of the total number of pins (including handicap pins) is maintained at the bottom of the scoring grids of FIGS. 3 and 4. In this way, the second team may "compete" against the first team, even though the first team is not currently bowling.

Although the invention is described above in terms of showing the scores of the bowlers on the first team as each bowler on the second team completes a frame, the invention is not limited in this respect. For example, if the game data includes scoring data for each ball rolled by the bowlers on the first team, the display for the bowlers of the first team may be updated after each ball rolled a bowler on the second team. In one implementation for enhancing the competition, the scoring data for the first eight frames may be shown on a frame-by-frame basis. Then, if the two teams are within a predetermined number of total pins (e.g., fifty pins) from each other any time after the completion of eight frames of bowling, the scores may thereafter be updated after each ball is rolled.

This arrangement of the present invention is particularly advantageous in league bowling where the members of a first team are unable to be present at a regularly scheduled bowling game. In this case, the first team can bowl, for example, prior to the regularly scheduled bowling. The game data for this bowling is stored and then later accessed by the lane pair control system of the lanes on which a second team is scheduled to bowl at the time of the regularly scheduled bowling game. Then as the second team is bowling, the game data is used to provide the scores for the corresponding bowlers on the first team as described above.

It is contemplated that the game data can also include video and/or audio data. One or more cameras and/or microphones may be arranged around the lane pair to capture images and/or sounds during one or more bowling games. The images and/or sounds may then be stored in memory 128 of lane pair control system 15, memory 122 of system control computer 30, or a portable memory module (e.g, magnetic or optical). When, for example, the video and/or audio data is stored in the memory 122 of system control computer 30, it may be communicated to the lane pair control system 15 via video/audio control system 70. Lane pair control system 15 provides for the output of the video and/or audio data via associated displays and speakers. The display of scoring data may be "synchronized" to the video and/or audio data. That is, as the bowler shown in the video bowls, the scoring displays may be updated in accordance with the bowling.

While there has been shown and described various embodiments of the present invention, it will be evident to those skilled in the art that various modifications may be made thereto without departing from the scope of the invention which is set forth in the appended claims.

I claim:

1. A system comprising:

a memory; and an automatic scoring system which provides automatic scoring for bowlers based on pinfall data and which stores in the memory scoring data for games bowled by one or more first bowlers, wherein, while one or more second bowlers are bowling at a time after the games bowled by the one or more first bowlers are completed, the automatic scoring system displays on one or more display screens scores for the second bowlers and, based on the scoring data stored in the memory, corresponding scores for the first bowlers.

2. The system according to claim 1, further comprising:

a user interface which enables selection of scoring data from the memory.

3. The system according to claim 1, wherein the memory further stores video data of the first bowlers and the automatic scoring system displays on the one more display screens video of the first bowlers synchronized with the displays of their scores.

4. The system according to claim 3, wherein the memory further stores audio data accompanying the video data.

5. The system according to claim 1, wherein the scoring data comprises ball-by-ball score data for each of the first bowlers.

6. The system according to claim 5, wherein the scoring data further comprises an identification of which pins were knocked down by each ball.

7. The system according to claim 1, wherein the scoring data comprises frame-by-frame score data for each of the first bowlers.

8. The system according to claim 1, wherein the scoring data comprises ball-by-ball score data for some frames and frame-by-frame score data for other frames for each of the first bowlers.

9. The system according to claim 1, wherein the memory comprises a portable memory module.

10. The system according to claim 1, wherein the memory further stores handicap data for each of the first bowlers.

11. A system comprising:

a memory; and an automatic scoring system which provides automatic scoring for bowlers based on pinfall data and which stores in the memory scoring data for games bowled by a first team of bowlers, wherein, while a second team of bowlers is bowling at a time after the games bowled by the first team of bowlers are completed, the automatic scoring system displays on one or more display screens scores for the second team of bowlers and, based on the scoring data stored in the memory, corresponding scores for the first team of bowlers.

12. The system according to claim 11, wherein the memory further stores video data showing the first team bowlers and the automatic scoring system displays on the one or more display screens video of the first team of bowlers synchronized with the displays of their scores.

13. The system according to claim 12, wherein the memory further stores audio data accompanying the video data.

14. The system according to claim 11, wherein the scoring data comprises ball-by-ball score data for each bowler of the first team.

15. The system according to claim 11, wherein the scoring data further comprises an identification of which pins were knocked down by each ball rolled by each bowler of the first team.

16. The system according to claim 11, wherein the scoring data comprises frame-by-frame score data for each bowler of the first team.

17. The system according to claim 11, wherein the scoring data comprises ball-by-ball score data for some frames and frame-by-frame score data for other frames for each bowler of the first team.

18. The system according to claim 11, wherein the memory comprises a portable memory module.

19. The system according to claim 11, wherein the memory further stores lineup data for the bowlers of the first team.

20. The system according to claim 11, wherein the memory further stores handicap data for each bowler of the first team.

* * * * *